US006167950B1

(12) United States Patent
Gupte et al.

(10) Patent No.: US 6,167,950 B1
(45) Date of Patent: Jan. 2, 2001

(54) HEAT TRANSFER TUBE

(75) Inventors: Neelkanth S. Gupte; Xin Liu, both of Syracuse; Steven J. Spencer, Liverpool; Robert H. L. Chiang, Manlius; Daniel Gaffaney, Chittenango, all of NY (US)

(73) Assignee: Carrier Corporation, Syracuse, NY (US)

( * ) Notice: Under 35 U.S.C. 154(b), the term of this patent shall be extended for 800 days.

(21) Appl. No.: 08/672,383

(22) Filed: May 28, 1996

Related U.S. Application Data

(63) Continuation of application No. 08/341,236, filed on Nov. 17, 1994, now abandoned.

(51) Int. Cl.[7] ..... F28F 13/18
(52) U.S. Cl. ..... 165/133; 165/184; 165/181
(58) Field of Search ..... 165/184, 181, 165/179, 133

(56) References Cited

U.S. PATENT DOCUMENTS

| | | | | |
|---|---|---|---|---|
| 4,166,498 | * | 9/1979 | Fujie et al. | 165/133 |
| 4,168,618 | * | 9/1979 | Saier et al. | 165/184 X |
| 4,245,695 | * | 1/1981 | Fujikako | 165/184 X |
| 4,305,460 | * | 12/1981 | Yampolsky | 165/179 |
| 4,549,606 | * | 10/1985 | Sato et al. | 165/179 |
| 4,733,698 | * | 3/1988 | Sato | 165/179 X |
| 5,186,252 | * | 2/1993 | Nishizawa et al. | 165/133 X |
| 5,203,404 | * | 4/1993 | Chiang et al. | 165/133 |
| 5,332,034 | * | 7/1994 | Chaing et al. | 165/133 X |
| 5,458,191 | * | 10/1995 | Chiang et al. | 165/133 |

FOREIGN PATENT DOCUMENTS

| | | | | |
|---|---|---|---|---|
| 0101760 | * | 8/1979 | (JP) | 29/890.048 |
| 0119192 | * | 7/1984 | (JP) | 165/184 |
| 0087036 | * | 3/1989 | (JP) | 29/890.048 |
| 0165875 | * | 6/1990 | (JP) | 165/179 |
| 3234302 | * | 10/1991 | (JP) | 165/184 |

* cited by examiner

*Primary Examiner*—Christopher Atkinson
(74) *Attorney, Agent, or Firm*—William W. Habelt

(57) ABSTRACT

A heat transfer tube (10) for use in an application, such as a shell and tube type air conditioning system condenser, in which a fluid flowing through the heat exchanger external to the tubes condenses by transfer of heat to a cooling fluid flowing through the tubes. The tube has at least one fin convolution (20) extending helically around its external surface (13). A pattern of notches (30) extends at an oblique angle ($\alpha$) across the fin convolutions at intervals about the circumference of the tube. There is a spike (22) between each pair of adjacent notches. The fin convolution, notches and spikes are formed in the tube by rolling the wall of the tube between a mandrel and, first, a gang of finning disks (63) and, second, a notching wheel (66). Because, during the manufacture of the tube, of the interaction of the rotating and advancing tube and the notching wheel, the angle ($\beta$) of inclination of the axis of the tip of the spike is oblique with respect to the notch angle. The maximum width ($W_t$) of the spike is greater than the width ($W_r$) of the proximal portion of the fin convolution.

3 Claims, 3 Drawing Sheets

HEAT TRANSFER TUBE

This Appln. is a con't of Ser. No. 08/341,236 filed Nov. 17, 1994 now abandoned.

BACKGROUND OF THE INVENTION

This invention relates generally to heat transfer tubes of the type used in shell and tube type heat exchangers. More particularly, the invention relates to a tube for use in an application such as a condenser for an air conditioning system.

A shell and tube type heat exchanger has a plurality of tubes contained within a shell. The tubes are usually arranged to provide a multiplicity of parallel flow paths for one of two fluids between which it is desired to exchange heat. The tubes are immersed in a second fluid that flows through the heat exchanger shell. Heat passes from the one fluid to the other fluid by through the walls of the tube. In one typical application, an air conditioning system condenser, a cooling fluid, usually water, flows through the tubes of the condenser. Refrigerant flows through the condenser shell, entering as a gas and leaving as a liquid. The heat transfer characteristics of the individual tubes largely determine the overall heat transfer capability of such a heat exchanger.

There are a number of generally known methods of improving the efficiency of heat transfer in a heat transfer tube. One of these is to increase the heat transfer area of the tube. In a condensing application, heat transfer performance is improved by maximizing the amount of tube surface area that is in contact with the fluid.

One of the most common methods employed to increase the heat transfer area of a heat exchanger tube is by placing fins on the outer surface of the tube. Fins can be made separately and attached to the outer surface of the tube or the wall of the tube can be worked by some process to form fins on the outer tube surface.

Beside the increased heat transfer area, a finned tube offers improved condensing heat transfer performance over a tube having a smooth outer surface for another reason. The condensing refrigerant forms a continuous film of liquid refrigerant on the outer surface of a smooth tube. The presence of the film reduces the heat transfer rate across the tube wall. Resistance to heat transfer across the film increases with film thickness. The film thickness on the fins is generally lower than on the main portion of the tube surface due to surface tension effects, thus lowering the heat transfer resistance through the fins.

It is possible, however, to attain even greater improvement in condensing heat transfer performance from a heat transfer tube as compared to a tube having a simple fin enhancement. Such a tube is described and claimed in U.S. Pat. No. 5,203,404, issued Apr. 20, 1993 to Chiang, et al. (the '404 tube), the assignee of which is the same entity as the assignee of the present invention.

SUMMARY OF THE INVENTION

The present invention is a heat transfer tube having one or more fin convolutions formed on its external surface. Notches extend at an oblique angle across the fin convolutions at intervals about the circumference of the tube.

The notches in the fin further increase the outer surface area of the tube as compared to a conventional finned tube. In addition, the configuration of the finned surface between the notches promote drainage of refrigerant from the fin. In most applications, the tubes in a shell and tube type air conditioning condenser run horizontally or nearly so. With horizontal tubes, the notched fin configuration promotes drainage of condensing refrigerant from the fins into the grooves between fins on the upper portion of the tube surface and also promotes drainage of condensed refrigerant off the tube on the lower portion of the tube surface.

The density of notches in the fin convolutions on the tube of the present invention is relatively high when compared to the same parameters in a prior art tube such as the '404 tube. The external surface area is therefore even larger. Furthermore, the increased number of notches per convolution revolution results in a fin surface between the notches that is spiked or "sharper" than prior art tubes such as the '404 tube, a configuration that even more strongly promotes drainage of condensed refrigerant from the tube.

Manufacture of a notched fin tube can be easily and economically accomplished by adding an additional notching disk to the tool gang of a finning machine of the type that forms fins on the outer surface of a tube by rolling the tube wall between an internal mandrel and external finning disks.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
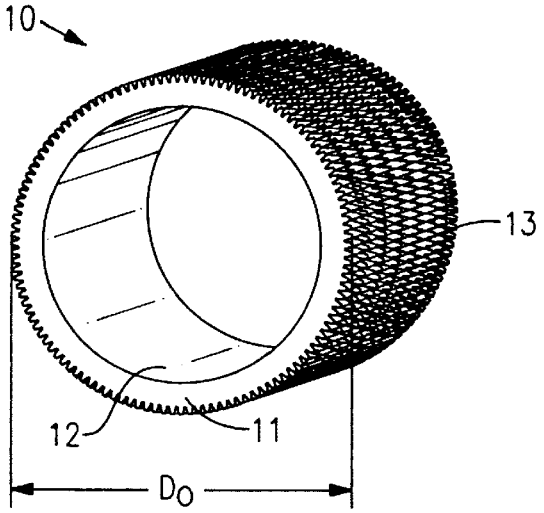
FIG. 1 is a pictorial view of the tube of the present invention.

FIG. 1 is a pictorial view of heat transfer tube 10. Tube 10 comprises tube wall 11, tube inner surface 12 and tube outer surface 13. Extending from the outer surface of tube wall 11 are external fins 22. Tube 10 has outer diameter $D_0$, including height of fins 22.

Figure 2:
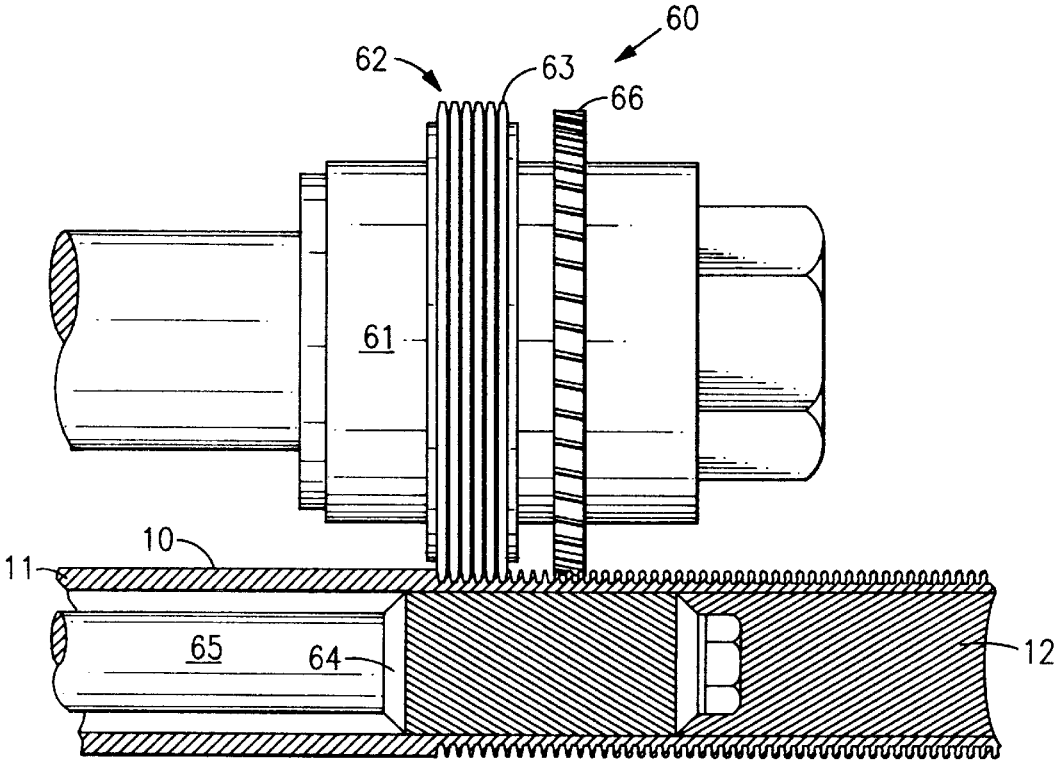
FIG. 2 is a view illustrating how the tube of the present invention is manufactured.

The tube of the present invention may be readily manufactured by a rolling process. FIG. 2 illustrates such a process. In FIG. 2, finning machine 60 is operating on tube 10, made of a malleable metal such as copper, to produce both interior ribs and exterior fins on the tube. Finning machine 60 has one or more tool arbors 61, each containing tool gang 62, comprised of a number of finning disks 63, and notching wheel 66. Extending into the tube is mandrel shaft 65 to which is attached mandrel 64.

Wall 11 is pressed between mandrel 65 and finning disks 63 as tube 10 rotates. Under pressure, metal flows into the grooves between the finning disks and forms a ridge or fin on the exterior surface of the tube. As it rotates, tube 10 advances between mandrel 64 and tool gang 62 (from left to right in FIG. 2) resulting in a number of helical fin convolutions being formed on the tube, the number being a function of the number of finning disks 63 in tool gang 62 and the number of tool arbors 61 in use on finning machine 60. In the same pass and just after tool gang 62 forms fins on tube 10, notching wheel 66 impresses oblique notches in to the metal of the fins.

Mandrel 64 may be configured in such a way, as shown in FIG. 2, that it will impress some type of pattern into the internal surface of the wall of the tube passing over it. A typical pattern is of one or more helical rib convolutions. Such a pattern can improve the efficiency of the heat transfer between the fluid flowing through the tube and the tube wall.

Figure 3:
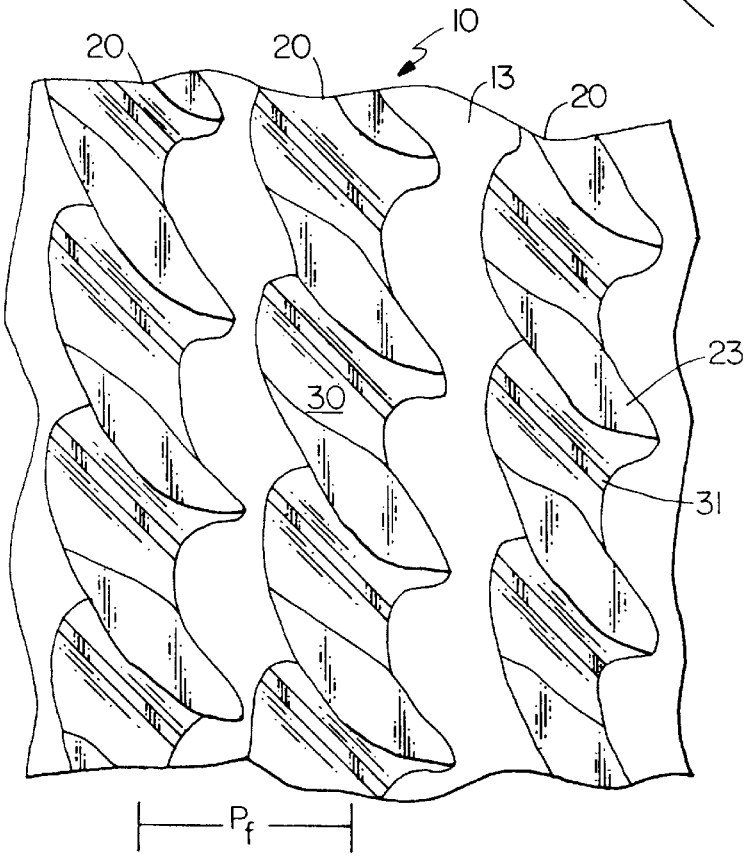
FIG. 3 is a plan view of a portion of the external surface of the tube of the present invention.

FIG. 3 shows, in plan view, a portion of the external surface of the tube. Extending from outer surface 13 of tube 10 are a number of fin convolutions 20. Extending obliquely across each fin convolution at intervals are a pattern of notches 30. Between each pair of adjacent notches in a given fin convolution is a fin spike (22) having a distal tip 23. The fin pitch, or distance between adjacent fin convolutions, is $P_f$.

Figure 4:
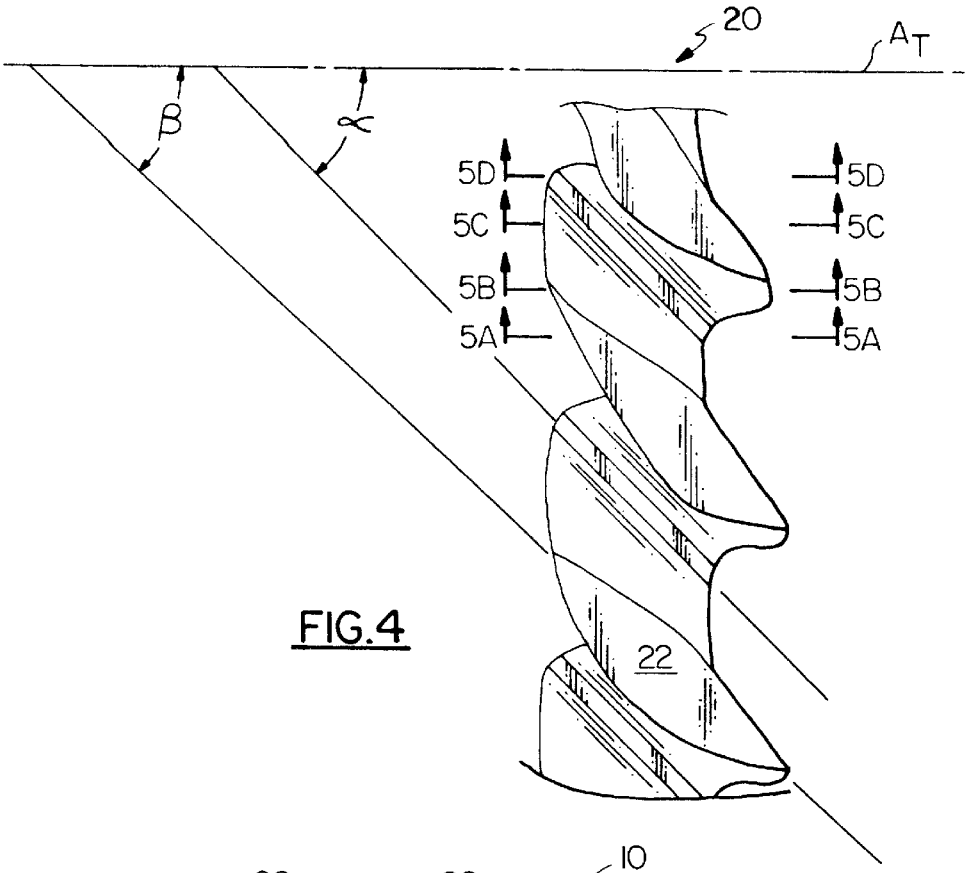
FIG. 4 is a plan view of a portion a single fin convolution of the tube of the present invention.

FIG. 4 is a plan view of a portion of a single fin convolution of the tube of the present invention. The angle of inclination of notch base 31 from longitudinal axis of the tube $A_T$ is angle $\alpha$. The angle of inclination of fin distal tip 22 from longitudinal axis of the tube $A_T$ is angle $\beta$. Because, during manufacture of the tube (see FIG. 2), of the interaction between rotating and advancing tube 10 and notching wheel 66, the axis of spike 22 is turned slightly from the angle between the teeth of the notching wheel and the fin convolution so that tip axis angle $\beta$ is oblique with respect to angle $\alpha$, i.e., $\beta \neq \alpha$.

Figure 5:
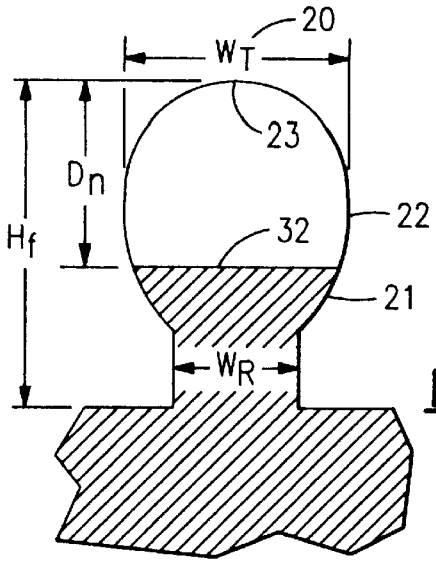
FIG. 5 is a generic sectioned elevation view of a single fin convolution of the tube of the present invention.
Figure 5A:
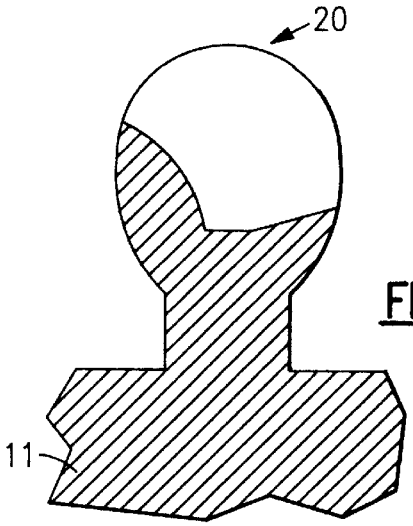
FIGS. 5A, 5B, 5C and 5D are sectioned elevation views, through, respectively, lines 5A—5A, 5B—5B, 5C—5C and 5D—5D in FIG. 4, of a single fin convolution of the tube of the present invention.
Figure 5B:
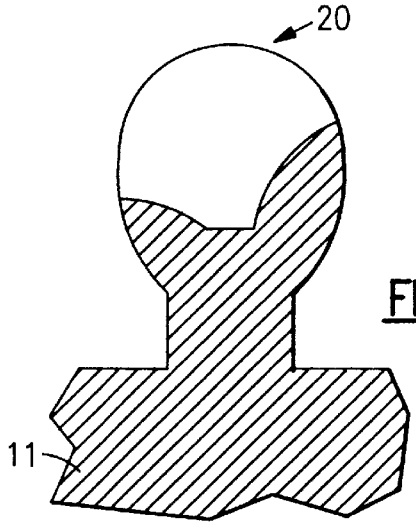
Figure 5C:
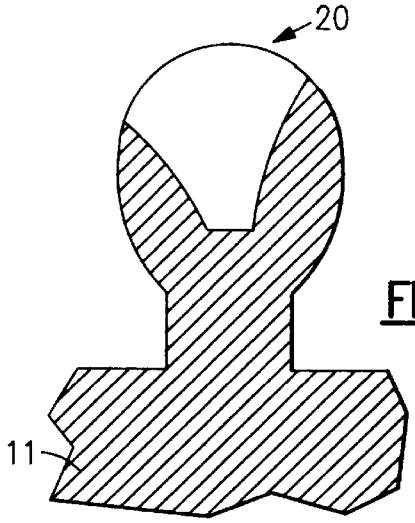
Figure 5D:
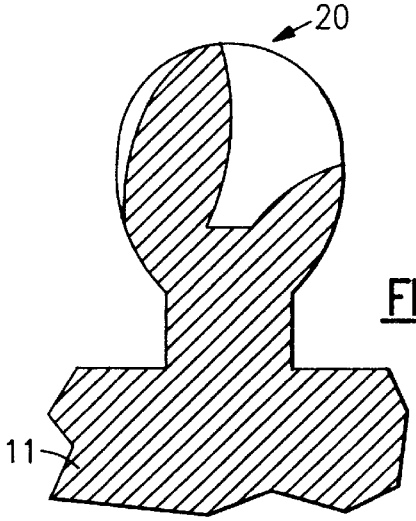

FIG. 5 is a pseudo sectioned elevation view of a single fin convolution of the tube of the present invention. We use the term pseudo because it is unlikely that a section taken through any part of the fin convolution would look exactly as the section depicted in FIG. 5. The figure, however, serves to illustrate many of the features of the tube. Fin convolution 20 extends outward from tube wall 11. Fin convolution 20 has proximal portion 21 and spike 22. Extending through the fin at the pseudo section illustrated in a notch having notch base 32. The overall height of fin convolution 20 is $H_f$. The width of proximal portion 21 is $W_r$ and the width of spike 22 at its widest dimension is $W_t$. The outer extremity of spike 22 is distal tip 23. The distance that the notch penetrates into the fin convolution or notch depth is $D_n$. Notching wheel 66 (FIG. 2) does not cut notches out of the fin convolutions during the manufacturing process but rather impresses notches into the fin convolutions. The excess material from the notched portion of the fin convolution moves both into the region between adjacent notches and outwardly from the sides of the fin convolution as well as toward tube wall 11 on the sides of the fin convolution. As a result, $W_t$ is greater than $W_r$.

FIGS. 5A, 5B, 5C and 5D are sectioned elevation views of fin convolution 20 respectively taken at lines 5A—5A, 5B—5B, 5C—5C and 5D—5D in FIG. 4. The views show more accurately the configuration of notched fin convolution 20 at various points as compared to the pseudo view of FIG. 5. The features of the notched fin convolution discussed above in connection with FIG. 5 apply equally to the illustrations in FIGS. 5A, 5B, 5C and 5D.

We have tested a prototype tube made according to the teaching of the present invention. That tube has a nominal outer diameter ($D_0$) of 19 millimeters (¾ inch), a fin height of 0.65 millimeter (0.0257 inches), a fin density of 22 fin convolutions per centimeter (56 fin convolutions per inch) of tube length, 122 notches per circumferential fin convolution, the axis of the notches being at an angle of inclination ($\alpha$) from the tube longitudinal axis ($A_T$) of 45 degrees and a notch depth of 0.20 millimeter (0.008 inch). The tested tube has three fin convolutions, or, as is the term in the art, three "starts." Test data indicates that the tube is 20 times as effective in refrigerant-to-tube wall heat transfer as a conventional tube having a smooth outer surface.

Extrapolations from test data indicate that the external surface configuration of the tube of the present invention is suitable for use in tubes having nominal outer diameters of from 12.5 millimeters (½ inch) to 25 millimeters (1 inch) where:

a) there are and 13 to 28 fin convolutions per centimeter (33 to 70 fin convolutions per inch) of tube length, i.e. the fin pitch is 0.36 to 0.84 millimeter (0.014 to 0.033 inch), or $$0.036 \text{ mm} < P_f < 0.84 \text{ mm } (0.014 \text{ inch} < P_f < 0.033 \text{ inch});$$

b) the ratio of fin height to tube outer diameter is between 0.02 and 0.055, or $$0.020 < H_f/D_0 < 0.055;$$

c) the density of notches in the fin convolution is 17 to 32 notches per centimeter (42 to 81 notches per inch);

d) the angle between the notch axis and the tube longitudinal axis is between 40 and 70 degrees, or $$40° < \alpha < 70° \text{ and}$$

e) the notch depth is between 0.2 and 0.8 of the fin height or $$0.2 < D_n/H_f < 0.8.$$

The optimum number of fin convolutions or fin "starts" depends more on considerations of ease of manufacture rather than the effect of the number on heat transfer performance. A higher number of starts increases the rate at which the fin convolutions can be formed on the tube surface but increases the stress on the finning tools.

We claim:

1. An improved heat transfer tube (10) in which the improvement comprises:

at least one external fin convolution (20) disposed helically about said tube;

notches (30) extending radially into said fin convolution at intervals about the circumference of said tube;

each of said notches having a base axis that is at an oblique angle ($\alpha$) with respect to the longitudinal axis ($A_T$) of said tube ranging from between 40 and 70 degrees;

said notches dividing said fin convolution into a proximal portion (21) having a maximum width ($W_r$) and a spike portion (22) having a single distal tip (23), said spike portion being between a pair of adjacent said notches and having a maximum width ($W_t$) that is greater than the maximum width ($W_r$) of said proximal portion and a distal tip axis ($\beta$) that is oblique to said notch base axis.

2. A heat transfer tube (10) comprising:

a tube wall (11) having an outer surface (13);

at least one fin convolution (20), formed by the interaction of a finning disk(63) and a mandrel (64), extending from said tube outer surface;

notches (30), formed by a notching wheel (66), extending radially into said fin convolution at intervals about the circumference of said tube and dividing said fin convolution into a proximal portion (21) having a maximum width ($W_r$) and a spike portion (22), each of said notches having a base axis that is at an oblique angle ($\alpha$) with respect to the longitudinal axis ($A_T$) of said tube ranging from between 40 and 70 degrees; and said spike portion having a single distal tip (23), said distal tip being between a pair of adjacent said notches and having a maximum width ($W_t$) that is greater than the maximum width ($W_r$) of said proximal portion and a distal tip axis ($\beta$) that is oblique to said notch base axis.

3. A heat transfer tube (10) comprising:

an elongated tube member having an outer diameter ($D_O$);

at least one external fin (20) disposed helically about said tube, the density of said fin about said tube ranging from 13 to 28 fin convolutions per centimeter (33 to 70 fin convolutions per inch) of tube, said external fin having a height ($H_f$), the ratio of the height of said fin to the outer diameter of said tube ranging from 0.020 to 0.055; and a plurality of notches (30) extending radially into said fin convolutions at intervals about the circumference of said tube, each of said notches having a base axis that is at an oblique angle ($\alpha$) with respect to the longitudinal axis ($A_T$) of said tube ranging from between 40 and 70 degrees, said notches dividing said fin convolutions into a plurality of proximal portions (21) each having a maximum width ($W_r$) and a plurality of spike portions (22) each having a distal tip (23), the density of said notches in said fin convolutions ranges from 17 to 32 notches per centimeter (42 to 81) notches per inch, the depth of said notches being between 0.2 and 0.8 of said fin height; said spike portion being a pair of adjacent said notches and having a maximum width ($W_t$) that is greater than the maximum width ($W_r$) of said proximal portion and a distal tip axis ($\beta$) that is oblique to said notch base axis.

* * * * *